US008591137B2

(12) United States Patent
Thompson et al.

(10) Patent No.: US 8,591,137 B2
(45) Date of Patent: Nov. 26, 2013

(54) BARRICADE FOR CROWD CONTROL

(75) Inventors: Bruce A. Thompson, Poynette, WI (US); Mark A. Hanson, Brooklyn, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 109 days.

(21) Appl. No.: 12/872,766

(22) Filed: Aug. 31, 2010

(65) Prior Publication Data

US 2012/0051837 A1 Mar. 1, 2012

(51) Int. Cl.
*E01F 13/02* (2006.01)

(52) U.S. Cl.
USPC ..... 404/6; 404/9; 256/13.1

(58) Field of Classification Search
USPC ..... 404/6, 9, 10; 116/63 P; 256/13.1, 59.1, 256/64; 40/610, 612; D25/67
See application file for complete search history.

(56) References Cited

U.S. PATENT DOCUMENTS

| | | | | | |
|---|---|---|---|---|---|
| 163,848 | A * | 6/1875 | Cary | 256/31 |
| 1,101,610 | A * | 6/1914 | Allard | 256/64 |
| 1,773,128 | A * | 8/1930 | Barrus | 256/64 |
| 1,998,520 | A * | 4/1935 | Penote | 256/64 |
| 3,035,660 | A * | 5/1962 | Leon | 182/186.5 |
| 3,950,873 | A * | 4/1976 | Stehle et al. | 40/607.02 |
| 4,279,105 | A * | 7/1981 | Cameron | 52/71 |
| 4,394,005 | A * | 7/1983 | Stewart | 256/64 |
| 5,046,885 | A * | 9/1991 | Thurston | 404/10 |
| 5,678,655 | A * | 10/1997 | Bearden | 182/182.1 |
| 5,762,444 | A | 6/1998 | Giannelli | |
| 6,131,320 | A * | 10/2000 | Eberle et al. | 40/610 |
| 6,237,895 | B1 * | 5/2001 | Thurston | 256/13.1 |
| 7,111,708 | B2 * | 9/2006 | Frey | 182/186.5 |
| 7,302,770 | B2 * | 12/2007 | Glass | 40/610 |

* cited by examiner

*Primary Examiner* — Matthew D Troutman
(74) *Attorney, Agent, or Firm* — Boyle Fredrickson, S.C.

(57) ABSTRACT

A barricade is provided for crowd control. The barricade includes a first frame support member having an upper end, a lower end, an upper opening adapted for receiving an end of a first upper beam therein and a lower opening. A second frame support member is positioned at an acute angle to the first support frame member and has an upper end, a lower end adjacent the lower end of the first frame support member, an upper opening adapted for receiving an end of a second upper beam therein and a lower opening. A lower beam has a first end receivable in the lower opening of the first frame support member and a second end receivable in the lower opening of the second frame support member to interconnect the first and second frame support members.

9 Claims, 3 Drawing Sheets

BARRICADE FOR CROWD CONTROL

FIELD OF THE INVENTION

This invention relates generally to crowd control, and in particular, to a barricade that interlocks adjacent beams to prevent crowds from simply pushing the beams apart and walking therepast.

BACKGROUND AND SUMMARY OF THE INVENTION

As is known, barricades are often used at construction or work sites to mark or surround an area and to warn vehicular or pedestrian traffic of possible danger. In addition, barricades are also used for crowd control to prevent pedestrian traffic from entering a predetermined area, such as a parade route or the like. By way of example, Giannelli, U.S. Pat. No. 5,762,444, discloses an A-frame barricade that has the capability of being adjusted to a desired length. The barricade includes a pair of A-frame leg support members and a generally elongate beam assembly which connects the leg support members. The beam assembly includes two beam members which are slidably joined by interlocking elements to enable adjustment of the length of the barricade.

While functional for its intended purpose, the A-frame barricade disclosed in the Giannelli '444 patent has certain limitations. More specifically, in order to prevent pedestrian traffic from entering a large protected area, such as a street, a number of A-frame barricades must be place end to end to isolate the area from the crowds. However, in the Giannelli '444 patent, no mechanism is provided for tying adjacent A-frame barricades together. Consequently, in order to access the protected area, individuals simply push the adjacent A-frame barricades apart and walk therebetween. As such, it is highly desirable to provide a barricade that interlocks adjacent supports to prevent crowds from simply pushing the supports apart and walking therepast.

Therefore, it is a primary object and feature of the present invention to provide a barricade that interlocks adjacent supports to prevent crowds from simply pushing the supports apart and walking therepast.

It is a further object and feature of the present invention to provide a barricade that interlocks adjacent supports to prevent crowds from simply pushing the supports apart and walking therepast that is simple to assemble and disassemble.

It is a further object and feature of the present invention to provide a barricade that interlocks adjacent supports to prevent crowds from simply pushing the supports apart and walking therepast that is inexpensive to manufacture and durable.

In accordance with the present invention, a barricade is provided for crowd control. The barricade includes a first frame support member having an upper end, a lower end, an upper opening adapted for receiving an end of a first upper beam therein and a lower opening. A second frame support member is at an acute angle to the first support frame member and has an upper end, a lower end adjacent the lower end of the first frame support member, an upper opening adapted for receiving an end of a second upper beam therein and a lower opening. The lower opening in the second frame support member is axially aligned with the lower opening in the first frame support member.

A lower beam has a first end receivable in the lower opening of the first frame support member and a second end receivable in the lower opening of the second frame support member. A first retaining member is operatively connectable to the first end of the lower beam for retaining the lower beam in the lower opening of the first frame support member. The lower beam may also include a first notch adjacent the first end thereof. The first retaining member is receivable in the first notch to retain the lower beam in the lower opening of the first frame support member. A second retaining member may be operatively connectable to the second end of the lower beam for retaining the lower beam in the lower opening of the second frame support member.

It is contemplated for the lower opening in the first frame support member to lie in a first plane and for the lower opening in the second frame support member to lie in a second plane. The second plane is at an acute angle to the first plane. In addition, the upper and lower openings in the first frame support member lie in a common plane.

In accordance with a further aspect of the present invention, a barricade is provided for crowd control. The barricade includes first and second frame support members. Each frame support member lies in corresponding plane and has an upper end, a lower end, an upper opening and a lower opening. A lower beam has a first end receivable in the lower opening of the first frame support member and a second end receivable in the lower opening of the second frame support member. The plane of first frame support member is at an acute angle to the plane of the second frame support member.

A first upper beam is receivable in the upper opening of the first frame support member and a second upper beam is receivable in the upper opening of the second frame support member. A first retaining member is operatively connectable to the lower beam for retaining the lower beam in the lower opening of the first frame support member. A second retaining member is operatively connectable to the second end of the lower beam for retaining the lower beam in the lower opening of the second frame support member. The lower beam may include a first notch adjacent the first end thereof for receiving the first retaining member and a second notch adjacent the second end thereof for receiving the second retaining member. The first and second notches diverge from each other and the upper and lower openings in the first frame support member lie in a common plane.

In accordance with a still further aspect of the present invention, a barricade is provided for crowd control. The barricade includes a first frame support member having an upper end, a lower end, an upper opening and a lower opening. A second frame support member is at an acute angle to the first frame support member and has an upper end, a lower end, an upper opening and a lower opening. The lower opening in the second frame support member is axially aligned with the lower opening in the first frame support member. A lower beam has a first end receivable in the lower opening of the first frame support member and a second end receivable in the lower opening of the second frame support member. A first retaining member is operatively connectable to the first end of the lower beam for retaining the lower beam in the lower opening of the first frame support member. A second retaining member is operatively connectable to the second end of the lower beam for retaining the lower beam in the lower opening of the second frame support member.

A first upper beam receivable in the upper opening of the first frame support member and a second upper beam receivable in the upper opening of the second frame support member. The lower beam may include a first notch adjacent the first end thereof. The first retaining member is receivable in the first notch to retain the lower beam in the lower opening of the first frame support member. In addition, the first retaining member may include a first notch. The first notch of the first retaining member forms a mating relationship with the first notch in the lower beam with the first retaining member received in the first notch of the lower beam. Similarly, the lower beam may include a second notch adjacent the second end thereof. The second retaining member is receivable in the second notch to retain the lower beam in the lower opening of the second frame support member.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
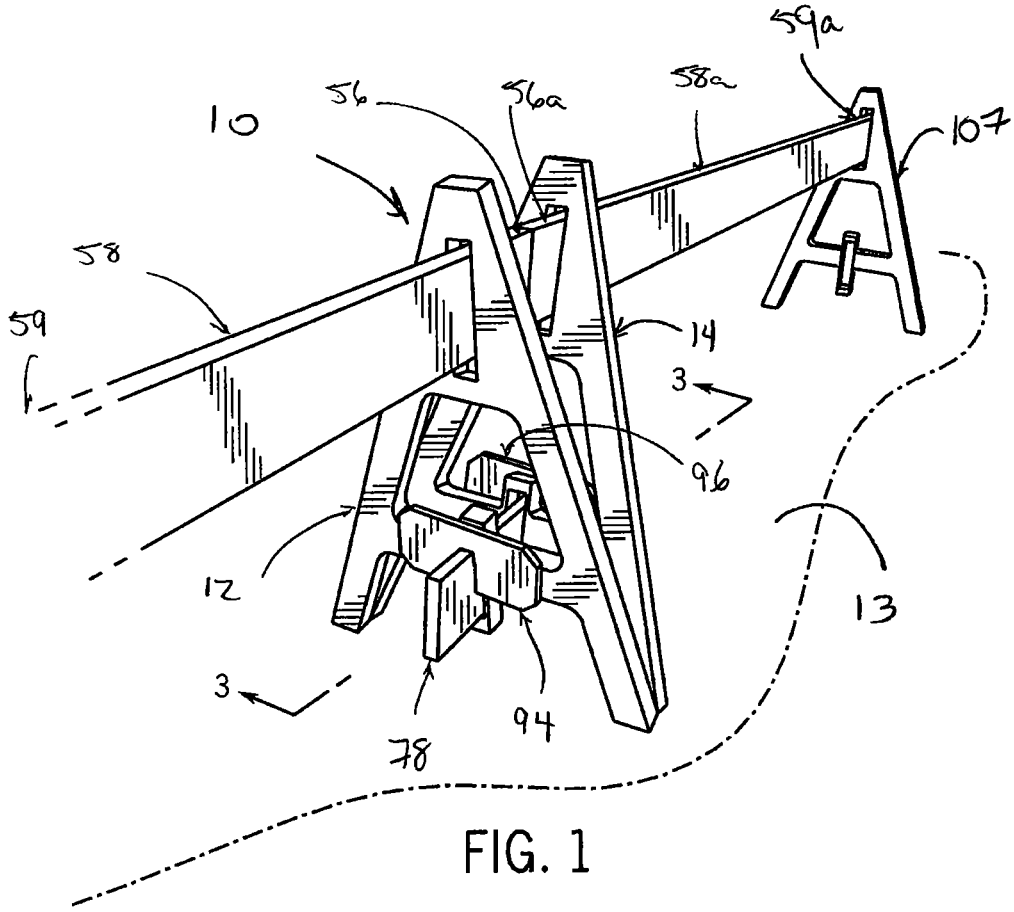
FIG. 1 is an isometric view of a barricade in accordance with the present invention.
Figure 2:
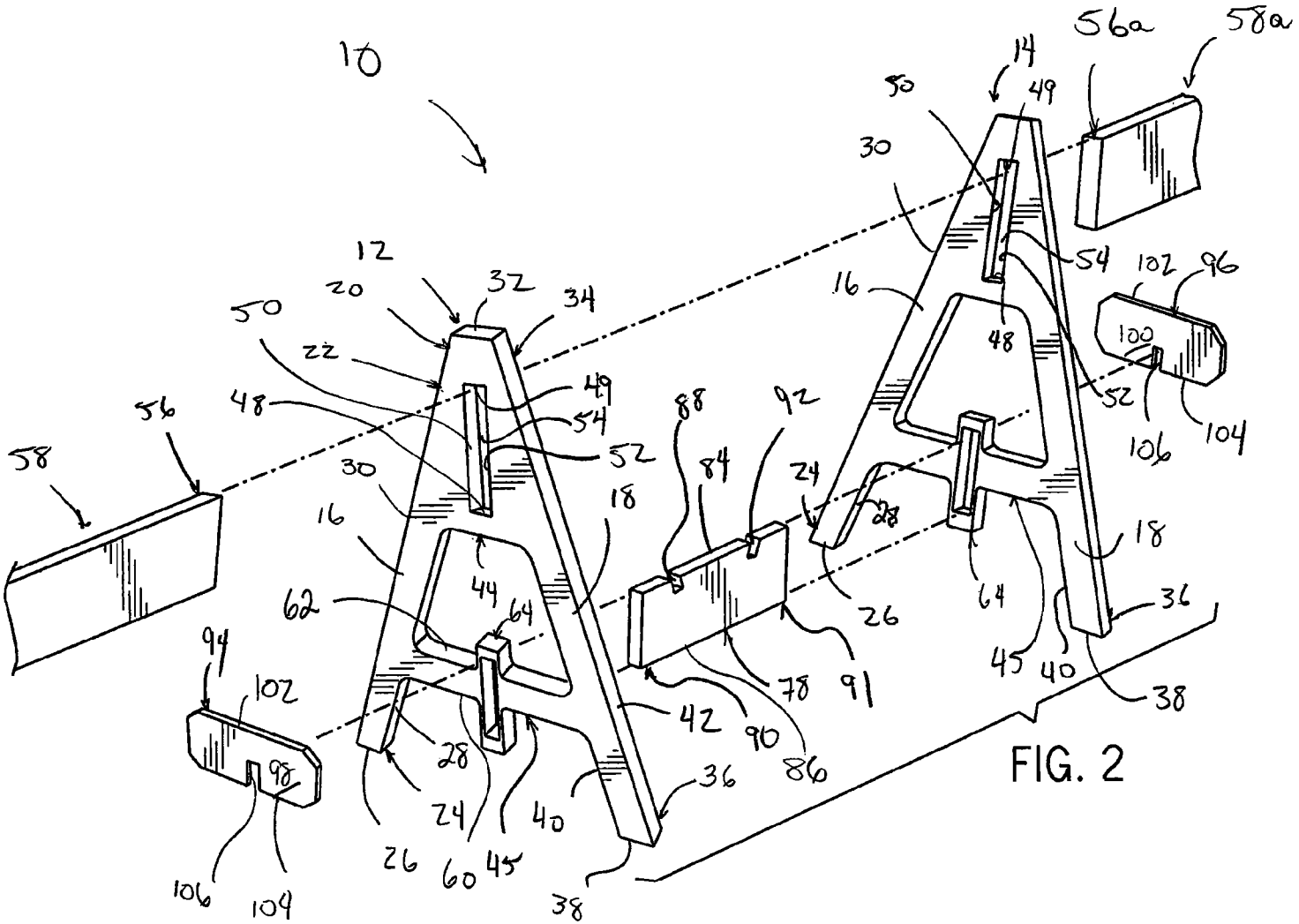
FIG. 2 is an exploded, isometric view of the barricade of FIG. 1.

Referring to FIGS. 1-2, a barricade in accordance with the present invention is generally designated by the reference numeral 10. Barricade 10 includes first and second generally A-shaped frame members 12 and 14, respectively, for receipt on supporting surface 13. First and second frame members 12 and 14, respectively, are identical in structure. As such, the following description of first frame member 12 is understood to describe second frame member 14 as if fully described herein.

Figure 3:
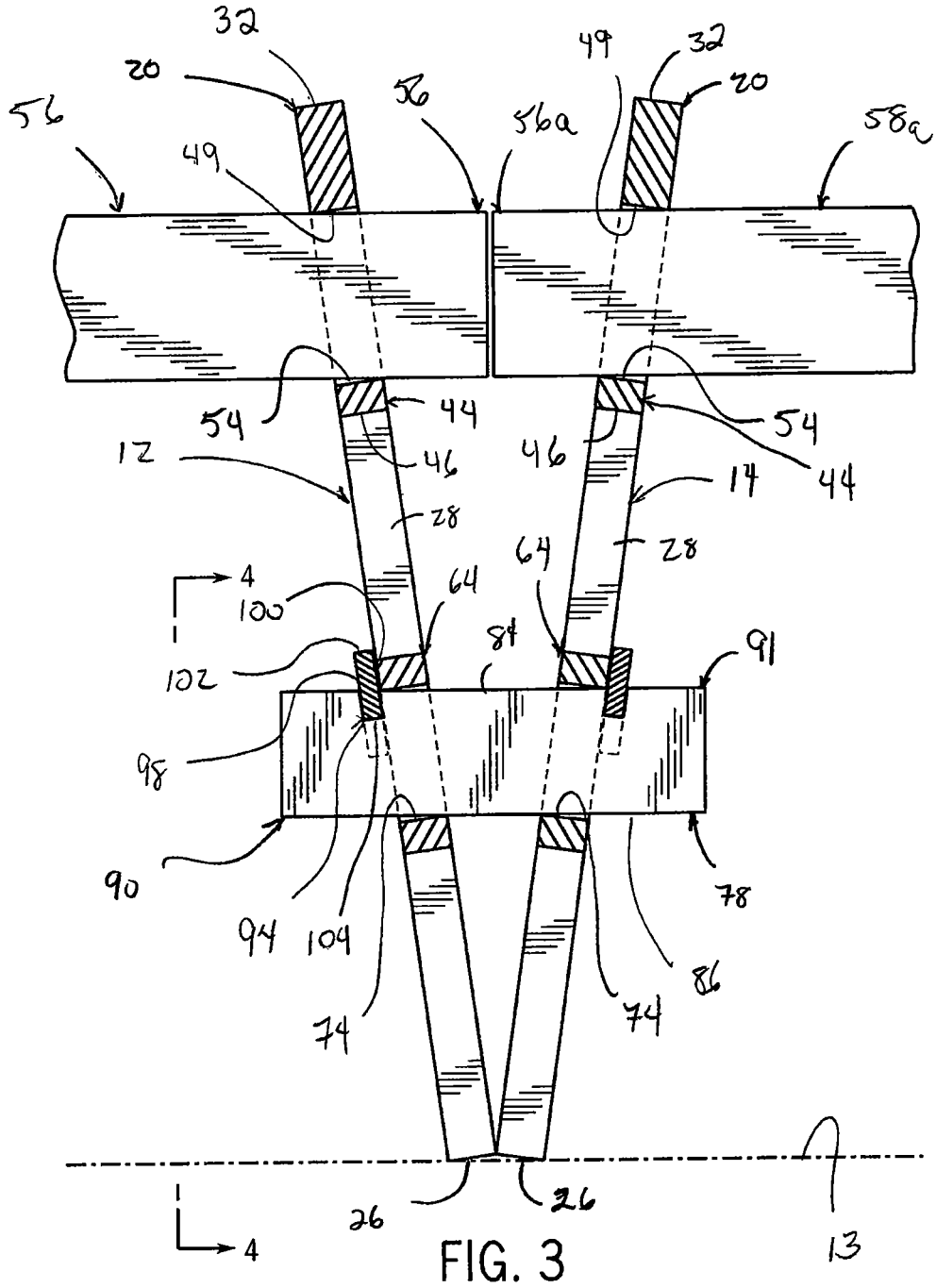
FIG. 3 is a cross sectional view of the barricade of the present invention taken along line 3-3 of FIG. 1.

As best seen in FIGS. 2-3, first frame member 12 includes first and second legs 16 and 18, respectively, depending from apex 20. First and second legs 16 and 18, respectively, are generally co-planar and diverge from each other. First leg 16 includes first end 22 intersecting apex 20 and second end 24. Second end 24 of first leg 16 terminates at a generally flat end surface 26. First leg 16 further includes inner surface 28 and outer surface 30. Outer surface 30 extends between and interconnects end surface 26 and upper surface 32 of apex 20. Second leg 18 includes first end 34 intersecting apex 20 and second end 36. Second end 36 of second leg 18 terminates at a generally flat end surface 38. Second leg 18 further includes inner surface 40 directed towards inner surface 28 of first leg 16 and outer surface 42. Outer surface 42 extends between and interconnects end surface 38 and upper surface 32 of apex 20.

Figure 4:
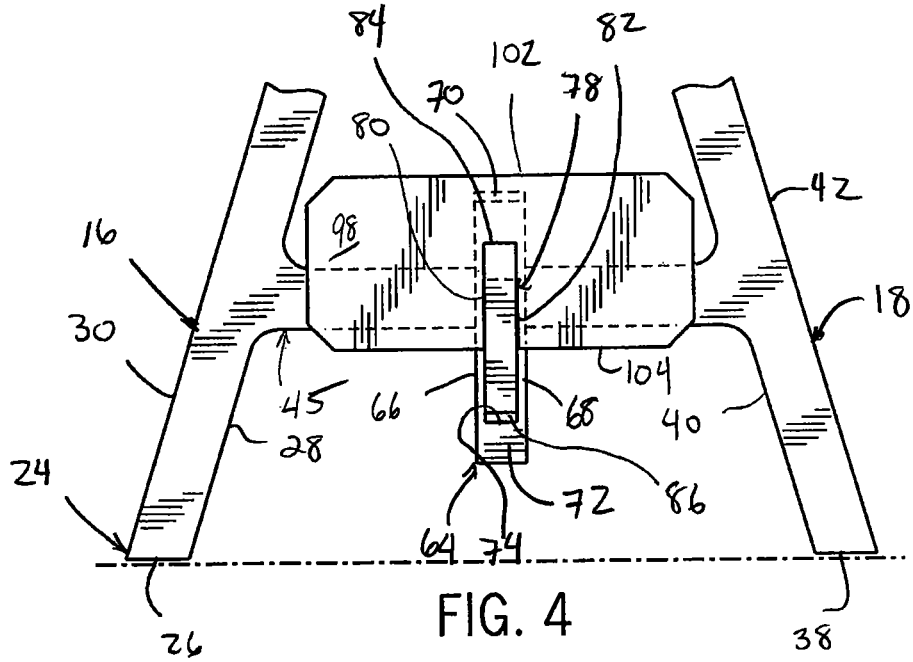
FIG. 4 is a cross sectional view of the barricade of the present invention taken along line 4-4 of FIG. 3.

First and second legs 16 and 18, respectively, of first frame member 12 are interconnected by upper cross leg 44 and lower cross leg 45. Upper cross leg 44 includes lower surface 46 extending between inner surface 28 of first leg 16 and inner surface 40 of second leg 18. Upper surface 48 of upper cross leg 44, lower surface 49 of apex 20, upper portion 50 of inner surface 28 of first leg 16, and upper portion 52 of inner surface 40 of second leg 18 define a generally rectangular upper opening 54 adapted for receiving first end 56 of an upper beam 58, as hereinafter described. Referring to FIGS. 2-4, lower cross leg 45 includes lower surface 60 extending between inner surface 28 of first leg 16 and inner surface 40 of second leg 18. Similarly, upper surface 62 of lower cross leg 45 extends between inner surface 28 of first leg 16 and inner surface 40 of second leg 18. Central portion 64 of lower cross leg 45 includes first and second spaced sidewalls 66 and 68, respectively, and upper and lower walls 70 and 72, respectively, defining a generally rectangular lower opening 74. Lower opening 74 is axially aligned with and lies in a common plane with upper opening 54. It is intended for lower opening 74 to receive an end of lower beam 78, as hereinafter described.

Lower beam 78 has a generally rectangular cross-section is defined by first and second elongated faces 80 and 82, respectively, and upper and lower edges 84 and 86, respectively. Lower beam 78 further includes first notch 88 in upper edge 84 at a location adjacent first end 90 thereof and second notch 92 in upper edge 84 at a location adjacent second end 91 thereof. First and second notches 88 and 92, respectively, diverge from each other and extend along corresponding axes. The axes of first and second notches 88 and 92, respectively, intersect and are at an acute angle to each other.

Barricade 10 further includes first and second retaining members 94 and 96, respectively, for retaining first and second ends 90 and 91, respectively, of lower beam 78 in corresponding lower openings 74 of first and second frame members 12 and 14, respectively. First and second retaining members 94 and 96, respectively, are identical in structure, and as such, the following description of first retaining member 94 is understood to describe second retaining member 96 as if fully described herein. First retaining member 94 has a generally rectangular cross-section is defined by first and second elongated faces 98 and 100, respectively, and upper and lower edges 102 and 104, respectively. The thickness of first retaining member 94 between first and second elongated faces 98 and 100, respectively, is less than the width of first and second notches 88 and 92, respectively, for reasons hereinafter described. First retaining member 94 further includes a centrally located notch 106 in lower edge 104 thereof. Notch 106 in first retaining member 94 has a width greater than the thickness of lower beam 78 between first and second elongated faces 80 and 82, respectively, thereof.

In operation, first and second frame members 12 and 14, respectively, are positioned at an acute angle to each other, FIGS. 1 and 3, such that: end surface 26 of first leg 16 and end surface 38 of second leg 18 of first frame member 12 are adjacent corresponding end surface 26 of first leg 16 and end surface 38 of second leg 18 of second frame member 14; apexes 20 of first and second frame members 12 and 14, respectively, are spaced from each other; and the plane in which lower opening 74 and upper opening 54 of first frame member 12 lie is at an acute angle to the plane in which lower opening 74 and upper opening 54 of second frame member 14 lie.

First end 90 of lower beam 78 is inserted into lower opening 74 of first frame member 12 and second end 91 of lower beam 78 is inserted into lower opening 74 of second frame member 14 such that first notch 88 in upper edge 84 of lower beam 78 is positioned outside of first frame member 12 and second notch 92 in upper edge 84 of lower beam 78 is positioned outside of second frame member 14. First and second retaining members 94 and 96, respectively, are provided to lock lower beam 78, and hence first and second frame members 12 and 14, respectively, in position. More specifically, first retaining member 94 engages lower beam 78 such that notch 106 in first retaining member 94 forms a mating relationship with first notch 88 in lower beam 78. Similarly, second retaining member 96 engages lower beam 78 such that notch 106 in second retaining member 96 forms a mating relationship with second notch 92 in lower beam 78.

With first and second frame members 12 and 14, respectively, interconnected as heretofore described, first end 56 of first upper beam 58 is inserted into upper opening 54 of first frame member 12 and first end 56*a* of a second upper beam 58*a* is inserted into upper opening 54 of second frame member 14 such that first end 56 of first upper beam 58 abuts first end 56*a* of second upper beam 58*a*. With first and second upper beams 58 and 58*a*, respectively, supported by first and second frame members 12 and 14, respectively, of barricade 10, the adjacent beams 58 and 58*a* are interlocked so as to prevent crowds from simply pushing the beams apart and walking therepast. Second ends 59 and 59*a* of first and second upper beams 58 and 58*a*, respectively, may be supported by additional frame member 107, identical in structure to first and second frame members 12 and 14, respectively, FIG. 1, or rested on supporting surface 13. Alternatively, second ends 59 and 59*a* of first and second upper beams 58 and 58*a*, respectively, may be supported by additional pairs of first and second frame members 12 and 14, respectively, assembled as heretofore described, so as to allow a plurality of barricades 10 to be interlocked.

Various modes of carrying out the invention are contemplated as being within the scope of the following claims particularly pointing out and distinctly claiming the subject matter, which is regarded as the invention.

We claim:

1. A barricade for crowd control, comprising:

a first frame support member having an upper end, a lower end engageable with a supporting surface, an upper first opening adapted for receiving an end of a first upper beam therein and a lower second opening; and a second frame support member at an acute angle to the first support frame member and having an upper end, a lower end adjacent the lower end of the first frame support member and being engageable with the supporting surface, an upper first opening adapted for receiving an end of a second upper beam therein and a lower second opening, the second opening in the second frame support member being axially aligned with the second opening in the first frame support member; and a lower beam having a first end receivable in the second opening of the first frame support member and a second end receivable in the second opening of the second frame support member for interconnecting the first and second frame support members, the lower beam including:

a first notch extending only partially through the lower beam at a location adjacent to the first end thereof and being adapted for receiving a first retaining member therein; and a second notch extending only partially through the lower beam at a location adjacent to the second end thereof for receiving a second retaining member therein, the first and second notches diverging from each other;

wherein the interconnected first and second frame support members have a generally V-shaped configuration projecting from the supporting surface.

2. The barricade of claim 1 wherein:

the second opening in the first frame support member lies in a first plane;

the second opening in the second frame support member lies in a second plane, the second plane being at an acute angle to the first plane.

3. The barricade of claim 1 wherein the first and second openings in the first frame support member lie in a common plane.

4. A barricade for crowd control, comprising:

first and second frame support members, each frame support member lying in a corresponding plane and having an upper end, a lower end engageable with a supporting surface, an upper opening and a lower opening; and a lower beam having a first end receivable in the lower opening of the first frame support member and a second end receivable in the lower opening of the second frame support member, the lower beam including:

a first notch extending only partially through the lower beam at a location adjacent the first end thereof and being adapted for receiving a first retaining member therein; and a second notch extending only partially through the lower beam at a location adjacent the second end thereof for receiving a second retaining member therein;

wherein:

the plane of first frame support member is at an acute angle to the plane of the second frame support member; and first and second frame support members have a generally V-shaped configuration projecting from the supporting surface.

5. The barricade of claim 4 further comprising:

a first upper beam receivable in the upper opening of the first frame support member; and a second upper beam receivable in the upper opening of the second frame support member.

6. The barricade of claim 4 wherein the upper and lower openings in the first frame support member lie in a common plane.

7. A barricade for crowd control, comprising:

a first frame support member having an upper end, a lower end engageable with a supporting surface, an upper opening and a lower opening;

a second frame support member at an acute angle to the first frame support member and having an upper end, a lower end engageable with the supporting surface, an upper opening and a lower opening, the lower opening in the second frame support member being axially aligned with the lower opening in the first frame support member;

a lower beam having a first end receivable in the lower opening of the first frame support member and a second end receivable in the lower opening of the second frame support member for interconnecting the first and second frame support members, the lower beam including:

a first notch extending only partially through the lower beam at a location adjacent the first end thereof; and a second notch extending only partially through the lower beam at a location adjacent the second end thereof;

a first retaining member receivable in the first notch at the first end of the lower beam for retaining the lower beam in the lower opening of the first frame support member; and a second retaining member receivable in the second notch at the second end of the lower beam for retaining the lower beam in the lower opening of the second frame support member;

wherein the interconnected first and second frame support members having a generally V-shaped configuration projecting from the supporting surface.

8. The barricade of claim 7 further comprising:

a first upper beam receivable in the upper opening of the first frame support member; and a second upper beam receivable in the upper opening of the second frame support member.

9. The barricade of claim 8 wherein the upper and lower openings in the first frame support member lie in a common plane.

* * * * *